United States Patent [19]

Terauchi

[11] 4,314,796

[45] Feb. 9, 1982

[54] SCROLL-TYPE COMPRESSOR WITH THRUST BEARING LUBRICATING AND BYPASS MEANS

[75] Inventor: Kiyoshi Terauchi, Isesaki, Japan

[73] Assignee: Sankyo Electric Company Limited, Isesaki, Japan

[21] Appl. No.: 70,870

[22] Filed: Aug. 29, 1979

[30] Foreign Application Priority Data

| | | | |
|---|---|---|---|
| Sep. 4, 1978 | [JP] | Japan | 53/108411 |
| Sep. 4, 1978 | [JP] | Japan | 53/108413 |
| Sep. 4, 1978 | [JP] | Japan | 53/108415 |
| Sep. 4, 1978 | [JP] | Japan | 53/108416 |
| Oct. 30, 1978 | [JP] | Japan | 53/134172 |
| Oct. 30, 1978 | [JP] | Japan | 53/134174 |

[51] Int. Cl.[3] ..... F04C 18/02; F04C 29/00; F04C 29/02; F04B 49/02

[52] U.S. Cl. ..... 417/294; 417/310; 418/55; 418/57; 418/94; 418/DIG. 1

[58] Field of Search ..... 418/55, 57, 94, DIG. 1; 64/31; 417/294, 310

[56] References Cited

U.S. PATENT DOCUMENTS

| | | | |
|---|---|---|---|
| 450,234 | 4/1891 | Johnson | 64/31 |
| 3,924,977 | 12/1975 | McCullough | 418/55 |
| 4,005,948 | 2/1977 | Hiraga et al. | 417/269 |
| 4,082,484 | 4/1978 | McCullough | 418/55 |

*Primary Examiner*—John J. Vrablik

*Attorney, Agent, or Firm*—Hopgood, Calimafde, Kalil, Blaustein & Judlowe

[57] ABSTRACT

A scroll-type refrigerant compressor unit is assembled by inserting parts into the compressor housing in a predetermined order and by finally securing a front end plate onto the compressor housing by bolts, which simplifies the production of the compressor unit. A drive shaft is supported by a single radial bearing, and a disk rotor having a drive pin to effect the orbital motion of the orbiting scroll member is fixedly mounted on the inner end of the drive shaft and is supported on the front end plate by a thrust bearing. Thus, the drive shaft and, therefore, the compressor unit are reduced in length and deflections and vibrations of the drive shaft are prevented. A lubricating system is provided to lubricate the shaft seal assembly on the drive shaft wherein the oil in the compressor housing is directed to the shaft seal cavity and returns to the interior of the compressor housing after lubricating the radial and thrust bearings and other parts. A mechanism for automatically reducing the amount of fluid compressed during high speed operation of the compressor unit is provided.

13 Claims, 12 Drawing Figures

SCROLL-TYPE COMPRESSOR WITH THRUST BEARING LUBRICATING AND BYPASS MEANS

BACKGROUND OF THE INVENTION

This invention relates to fluid displacement apparatus, and in particular, to fluid compressor units of the scroll type.

Scroll type apparatus has been well known in the prior art as disclosed in, for example, U.S. Pat. No. 801,182, and others, which include two scroll members each having an end plate and a spiroidal or involute spiral element. The scroll members are maintained angularly and radially offset so that both of spiral elements interfit so as to maintain a plurality of line contacts between the spiral curved surfaces to thereby seal off and define at least one fluid pocket. The relative orbital motion of the scroll members shifts the line contacts along the spiral curved surfaces and, therefore, the fluid pocket changes in volume. The volume of the fluid pocket increases or decreases dependent on the direction of orbital motion. Therefore, scroll-type apparatus is applicable to compress, expand or pump fluids.

In comparison with conventional compressors of the piston type, a scroll-type compressor has advantages, such as a lesser number of parts, continuous compression of fluid and others. However, there have been several problems; primarily sealing of the fluid pocket, wear on the spiral elements, and inlet and outlet porting.

Although many patents, such as, U.S. Pat. Nos. 3,884,599, 3,924,977, 3,994,633, 3,994,636, and 3,994,635 have attempted to resolve these and other problems, the resultant compressor is complicated in construction and in production. Furthermore, because a plurality of spaced radial bearings are used to support the drive shaft, the axial length of the drive shaft is increased so that the resultant compressor is increased in length, volume and weight.

In compressors of this type, lubricating systems are also required for lubricating the moving parts.

Since a compressor of this type is compact and light, it is advantageously used as a refrigerant compressor for a air conditioner in an automobile. However, if an automobile engine is used as a power source for the compressor, the compressor is driven at various speeds dependent on the rotational speed of the automobile engine. Therefore, the amount of compressed fluid discharged during a unit of time at a time when the speed of the automobile engine is, for example, 5,000 r.p.m., is much more than that at a time when the speed of the automobile engine is 1,000 r.p.m. Such a large variation in the amount of compressed fluid supplied is not desirable in the refrigerant circulating circuit which is connected to the compressor.

SUMMARY OF THE INVENTION

It is an object of this invention to provide an improved compressor unit of the scroll type which is excellent in sealing and an anti-wearing, and simple in porting.

It is another object of this invention to provide a compressor unit of the scroll type wherein the drive shaft axis and the axes of the other moving parts are securely prevented from deflection during operation.

It is still another object of this invention to provide a compressor unit of the scroll type which has an improved lubricating system for the moving parts.

It is yet another object of this invention to provide a compressor unit of the scroll type which has means for permitting compressed fluid to be removed from the fluid pockets of the compressor during high speed operation of the compressor unit.

It is a further object of this invention to provide a compressor unit of the scroll type which is simple in construction and production with the above described objects being achieved.

A compressor unit of the scroll type according to this invention comprises a compressor housing having front and rear end plates. A fixed scroll member is disposed within the compressor housing with first end plate means and first wrap means affixed to the first end plate means. An orbiting scroll member is disposed within the compressor housing which has second end plate means and second wrap means affixed to the second end plate means. The first and second wrap means interfit at a predetermined angular relationship in a plurality of line contacts to define at least one sealed off fluid pocket which moves with a consequent reduction of volume by the orbital motion of the orbiting scroll member. A drive shaft is rotatably supported by first radial bearing means in the front end plate and extends outwardly through the front end plate. A disk rotor member is mounted on an inner end of the drive shaft and is supported by first thrust bearing means on an inner surface of the front end plate. A drive pin axially projects from a rear surface of the disk rotor member and is radially offset from the axis of the drive shaft. The orbiting scroll member is provided with an axial boss which is disposed on a surface of the second end plate means opposite the second wrap means. The boss is fitted onto the drive pin through second radial bearing means so that the orbiting scroll member is rotatably mounted on the drive pin. A radial flange member radially extends from and is disposed on the projecting end of the axial boss, and is supported by second thrust bearing means on the rear surface of the disk rotor member. Means for preventing the rotation of the orbiting scroll member, but permitting the orbiting scroll member to effect the orbital movement, are disposed between the radial flange member and the second end plate means of the orbiting scroll member.

The rotation preventing means comprise a hollow member having a rectangular outer contour and non-rotatably fitted onto the axial boss. A slider member is fitted on the hollow member slidable in a first radial direction with a rectangular hole and a rectangular outer contour with four sides parallel to the respective four sides of the rectangular hole. The first pair of parallel sides of the rectangular hole are equal in length to a pair of parallel sides of the outer rectangle of the hollow member. The second pair of parallel sides are longer than the other pair of parallel sides of the hollow member so that the slider member may slide on the hollow member along the second pair of parallel sides. A guide member non-rotatably disposed within the housing and having guide surfaces for respective parallel outer surfaces of the slider member in parallel with the first pair of parallel sides permits movement of the slider member in a second radial direction perpendicular to the first radial direction, to thereby permit orbital motion, but prevent rotation, of the orbiting scroll member.

The rear end plate of the compressor housing is provided with a fluid outlet port, and a first annular wall axially projecting from the inner surface of the rear end plate around the fluid outlet port. The fixed scroll member is provided with a fluid discharge port at the center of the first end plate means. A second annular wall axially projects from a surface of the first end plate means opposite the first wrap means around the fluid discharge port. The first and second annular walls are fitted into one another to define a chamber therein. A sealing ring member of elastic material is compressedly fitted into the gap between the first and second annular walls, to thereby seal off the chamber from an annular chamber portion surrounding the fitted annular walls and to axially and radially elastically support the fixed scroll member.

In the arrangement of the compressor unit, the sealing ring member, fixed and orbiting scroll members, rotation preventing means, radial flange member, second radial bearing means, second thrust bearing means, and a pre-assembly of the drive pin, disk rotor member, first thrust bearing means, first radial bearing means, drive shaft, and front end plate, are inserted in this order into the compressor housing, and the compressor unit is easily completed by securing the front end plate onto the compressor housing.

In another aspect of this invention, the compressor unit includes an oil deflector depending from the inner wall of the compressor housing. The front end plate is provided with a shaft seal cavity around the drive shaft, and is formed with an oil opening disposed adjacent to the oil deflector and with a first passageway therein for effecting communication between the oil opening and the shaft seal cavity. A second passageway is formed to extend through the drive shaft and the drive pin, and to effect communication between the shaft seal cavity and the hollow space of the boss. Therefore the lubricating oil of the inner wall of the compressor housing is directed by the deflector through the oil opening and into the shaft seal cavity. The oil in the shaft seal cavity in part flows along the drive shaft lubricating the first radial bearing means and, then, flows through the gap between the front end plate and the disk rotor member to lubricate the first thrust bearing means. The remainder of the oil flows through the second passageway into the hollow space of the boss to lubricate the second radial and thrust bearing means.

A fluid inlet port is formed in the rear end plate for introducing refrigerant gas into the interior of the compressor housing. An oil separating plate member is fixedly disposed in front of the inlet port. The oil mixed with the refrigerant gas strikes against, and adheres to, the oil separating plate member and is separated from the refrigerant gas to flow down along the plate.

In a further aspect of this invention, the second end plate means of the orbiting scroll member is provided with a round depression in a surface opposite to the second wrap means and a small aperture at the center of the round depression. A ball is received in the round depression to close the aperture. Spring means are provided to urge the ball into the round depression at the center thereof. Thus, when the compressor is driven at high speed, the ball is displaced from the center of the round depression to open the aperture. This permits the compressed gas in the moving fluid pockets to pass into the interior of the compressor housing. Therefore, the amount of gas compressed during a unit time is decreased and, therefore, is substantially unchanged from that at a time when the compressor is driven at a lower speed.

Further objects, features and other aspects will be understood from the detailed description of the preferred embodiments of this invention with reference to the annexed drawings.

Figure 4:
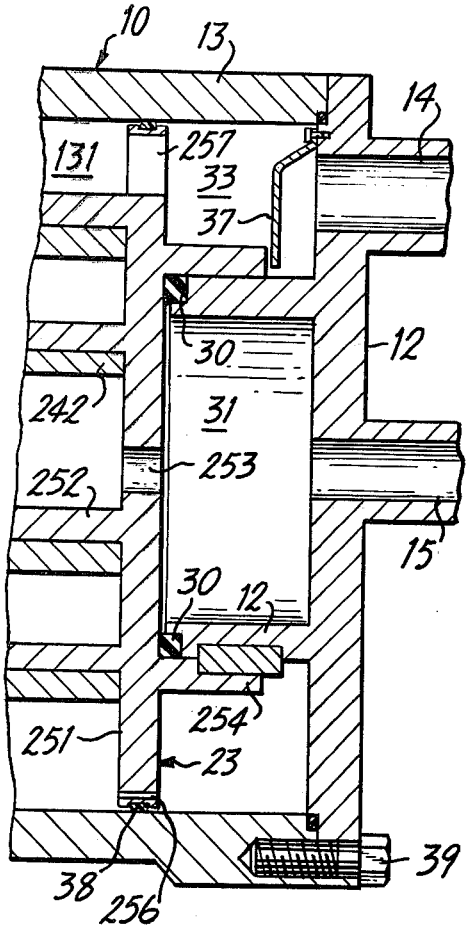
Figure 5:
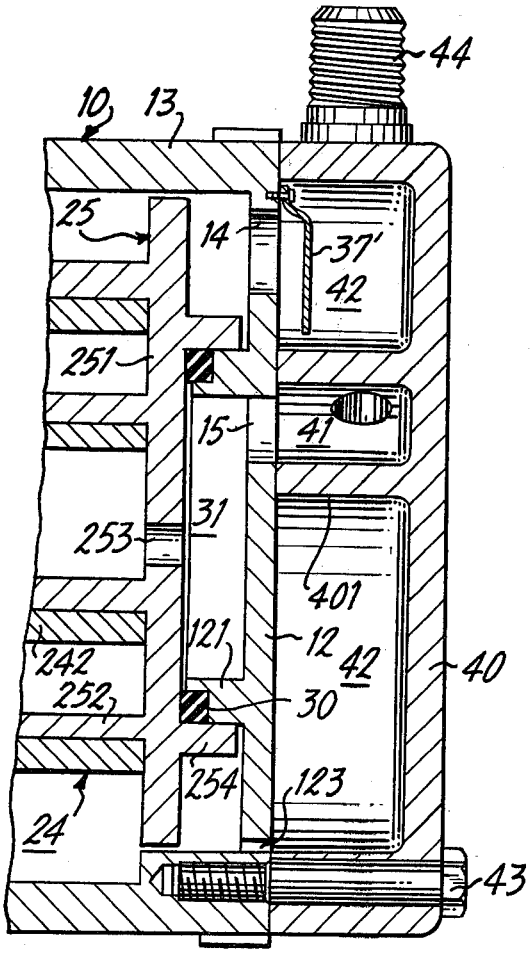
Figure 6:
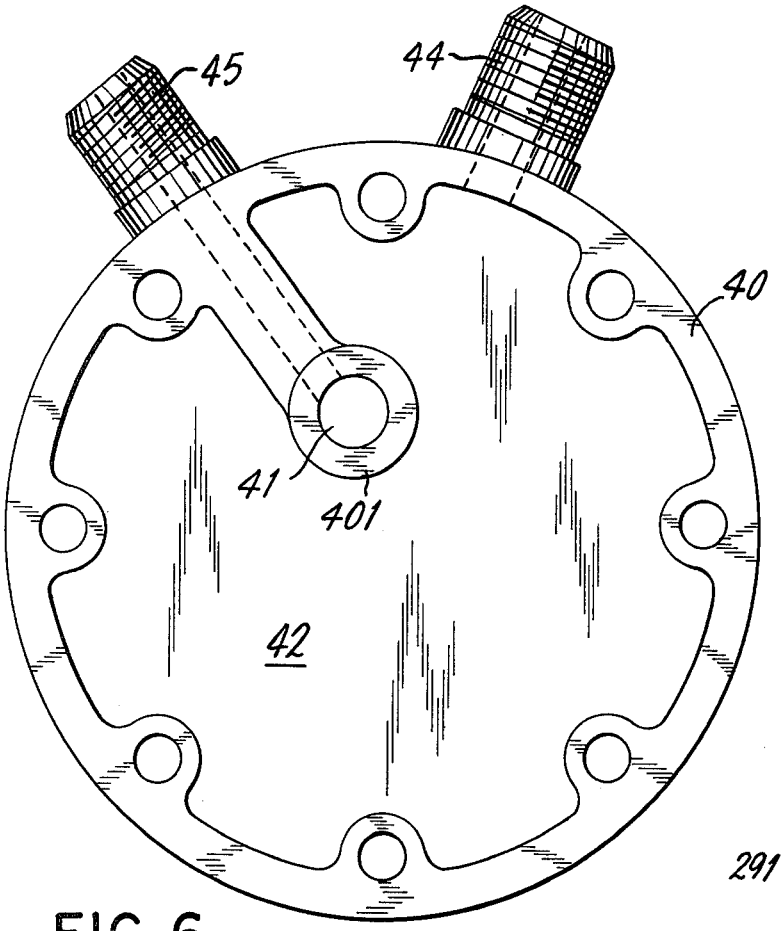
Figure 9:
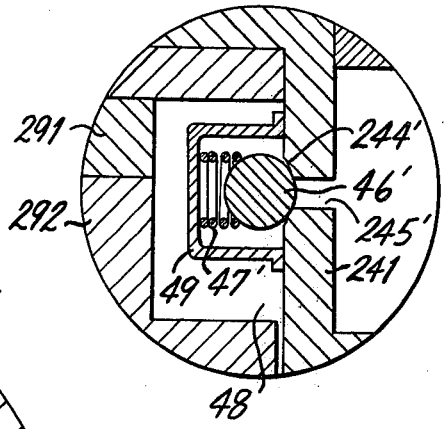
Figure 8:
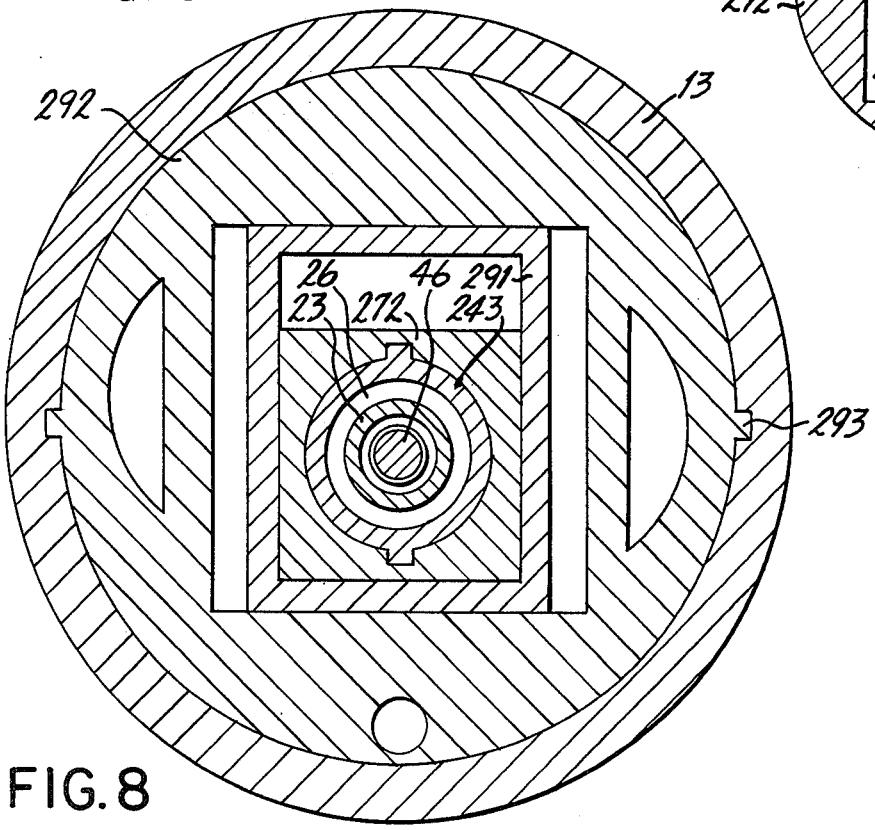
Figure 7:
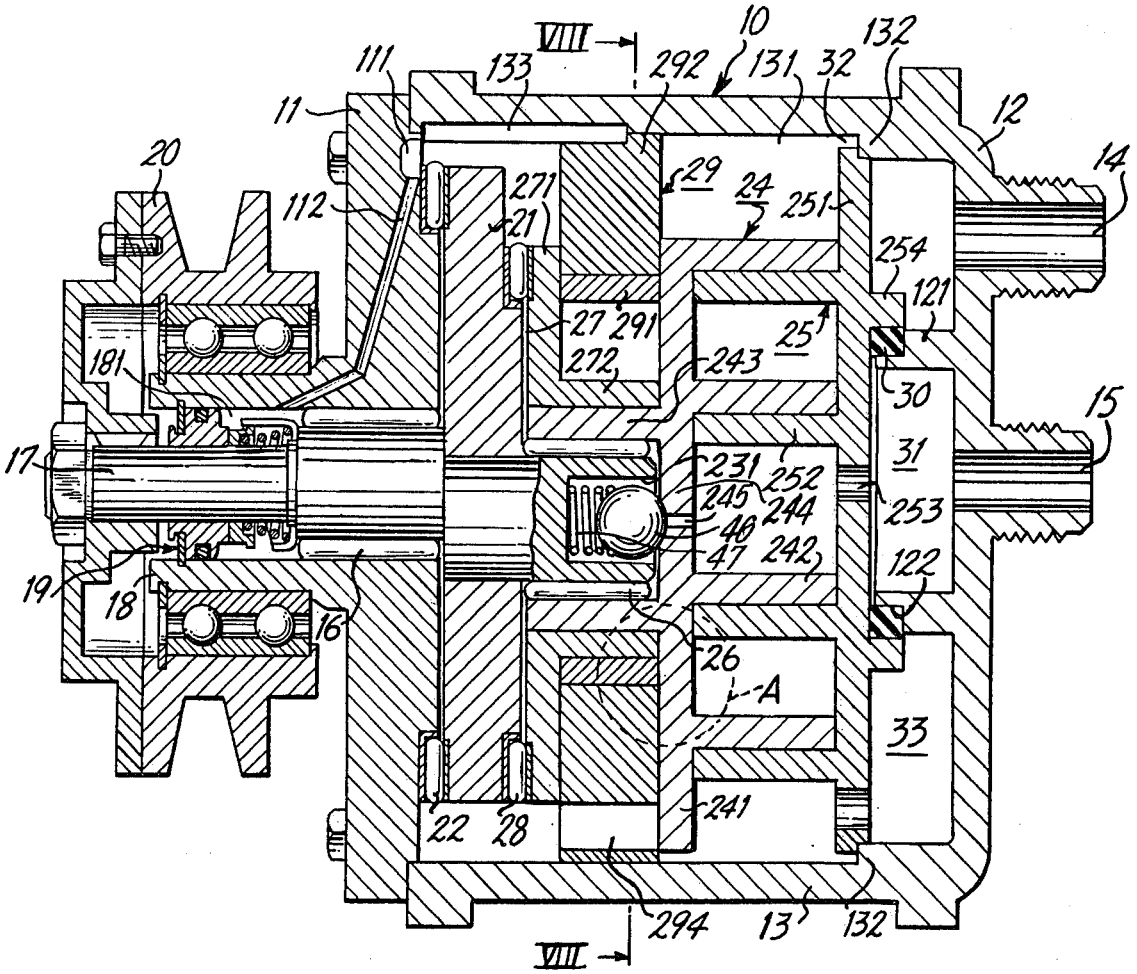

FIGS. *3a—3d* are schematic views illustrating the movement of interfitting spiral elements to compress the fluid;

FIG. 4 is a vertical sectional view of a main part of another embodiment of this invention;

FIG. 5 is vertical sectional view of a main part of still another embodiment of this invention;

FIG. 6 is a front view of a head block used in the embodiment shown in FIG. 5;

FIG. 7 is a vertical sectional view of a further embodiment of this invention;

FIG. 8 is a cross-sectional view taken along line VIII—VIII in FIG. 7; and FIG. 9 is a sectional view of a modification of the embodiment of FIG. 7.

DETAILED DESCRIPTION OF PREFERRED EMBODIMENTS

Figure 1:
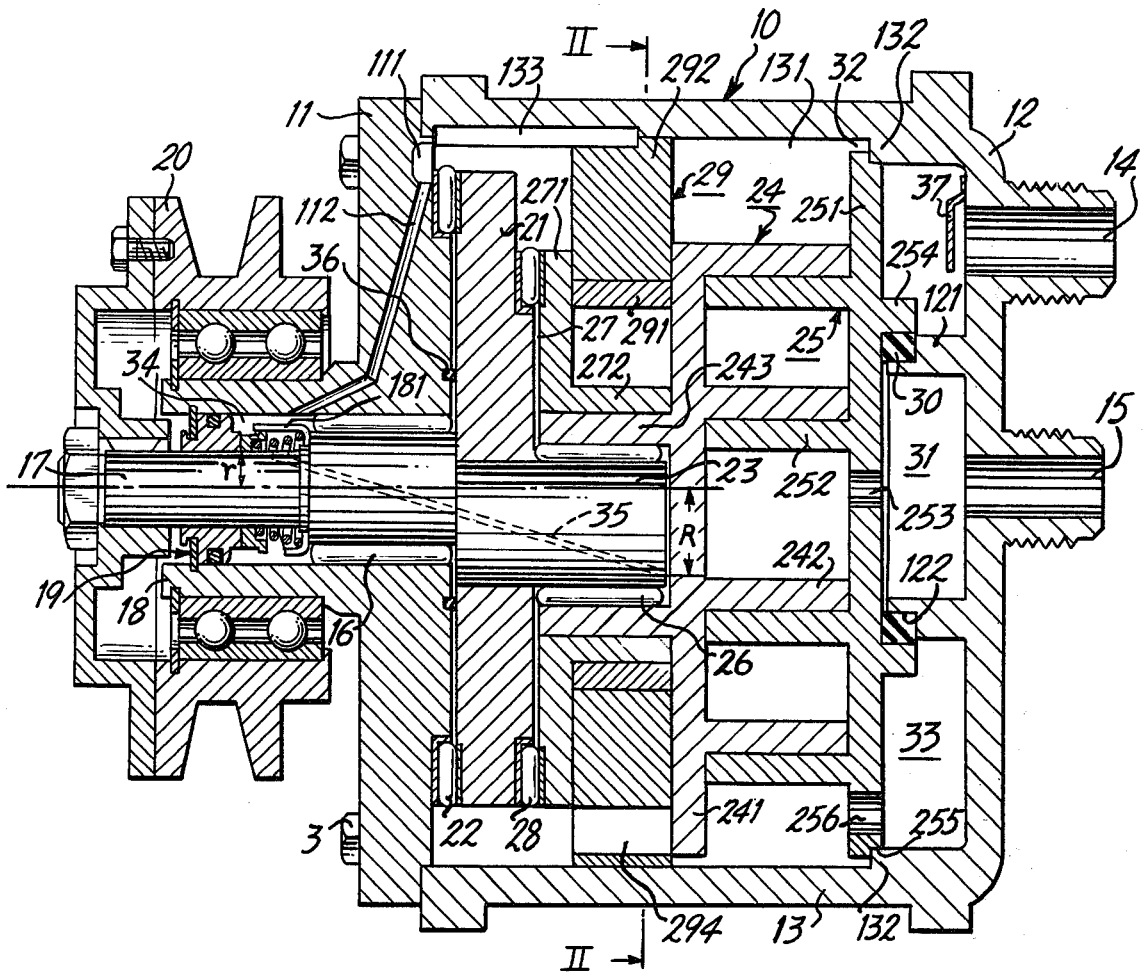
FIG. 1 shows a vertical sectional view of a compressor unit of the scroll type according to an embodiment of this invention.

Referring to FIG. 1, a refrigerant compressor unit 10 of the embodiment shown includes a compressor housing comprising a front end plate 11, a rear end plate 12 and a cylindrical body 13 connecting the end plates. Rear end plate 12 is shown integrally formed with cylindrical body 13 and is provided with a fluid inlet port 14 and a fluid outlet port 15 formed therewith. A drive shaft 17 is rotatably supported by a radial needle bearing 16 in front end plate 11. Front end plate 11 has a sleeve portion 18 projecting from the front surface thereof and surrounding drive shaft 17 to define a shaft seal cavity 181. Within shaft seal cavity 181, a shaft seal assembly 19 is assembled on drive shaft 17. A pulley 20 is rotatably mounted on sleeve portion 18 and is connected with drive shaft 17 to transmit an external power source (not shown) to drive shaft 17 through belt means (not shown) wound around pulley 20. A disk rotor 21 is fixedly mounted on an inner end of drive shaft 17 and is born on the inner surface of front end plate 11 through a thrust needle bearing 22 which is disposed concentrically with drive shaft 17. Disk rotor 21 is provided with a drive pin 23 projecting from the rear surface thereof. Drive pin 23 is radially offset from drive shaft 17 by a predetermined amount.

Reference numerals 24 and 25 represent a pair of interfitting orbiting and fixed scroll members. Orbiting scroll member 24 includes an circular end plate 241 and a wrap means or spiral element 242 affixed onto one end surface of the end plate. End plate 241 is provided with a boss 243 projecting from the other end surface thereof. Drive pin 23 is fitted into the boss 243 with a radial needle bearing 26 therebetween, so that orbiting scroll member 24 is rotatably supported on drive pin 23.

A hollow member 27 having a radial flange 271 is non-rotatably fitted on boss 243 by means of a key and keyway connection. Radial flange 271 is supported on the rear end surface of disk rotor 21 by a thrust needle bearing 28 which is concentrically disposed with drive pin 23. Axial length of the hollow member 27 is equal to, or longer than, the axial length of boss 243, so that the thrust load from orbiting scroll member 24 is supported on front end plate 11 through disk rotor 21. Therefore, the rotation of drive shaft 17 effects the orbital motion of orbiting scroll member 24 together with hollow member 27. Specifically, orbiting scroll member 24 moves along a circle of a radius of a length of the offset between drive shaft 17 and drive pin 23.

Means 29 for preventing orbiting scroll member 24 from rotating during the orbital motion are disposed between end plate 241 of orbiting scroll member 24 and radial flange 271 of hollow member 27.

Figure 2:
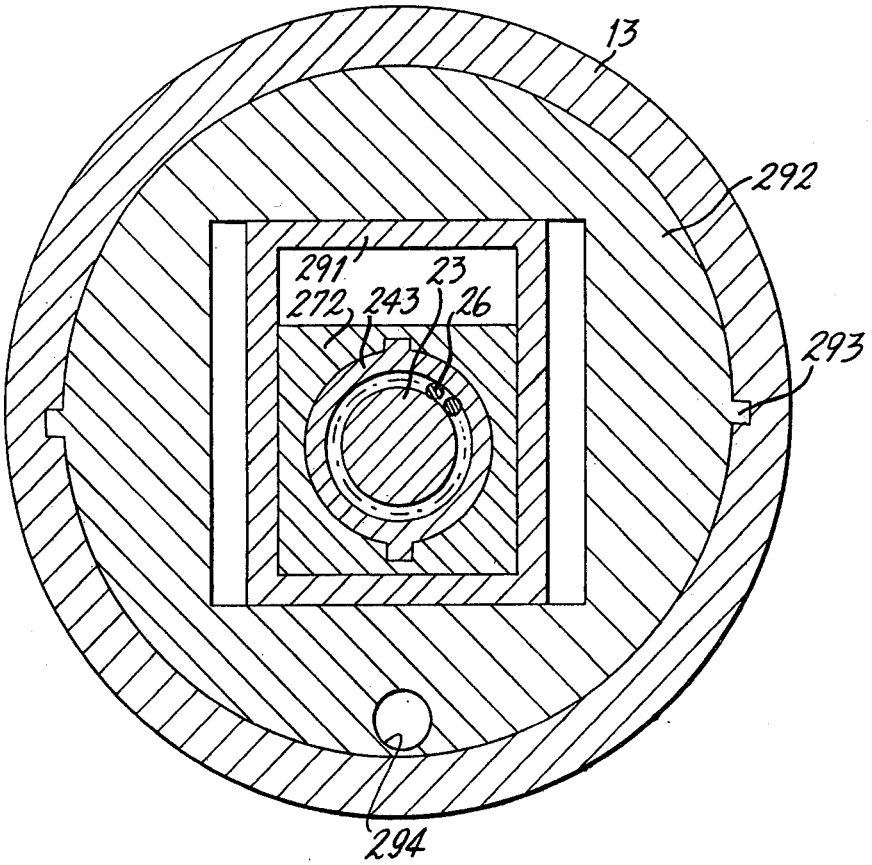
FIG. 2 is a cross-sectional view taken along line II—II in FIG. 1.
Figure 3A:
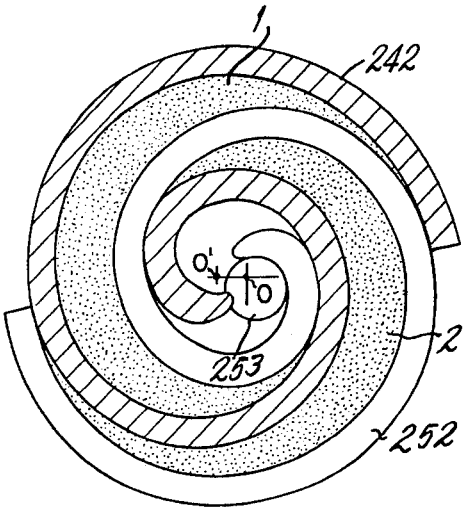
Figure 3B:
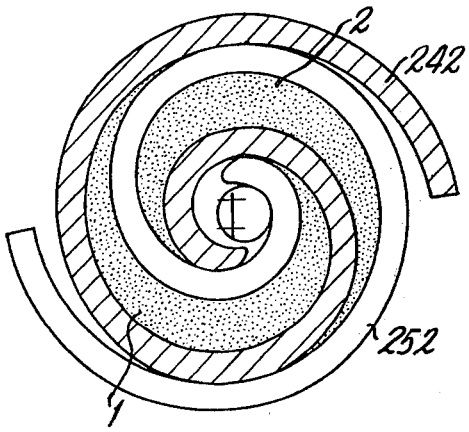
Figure 3C:
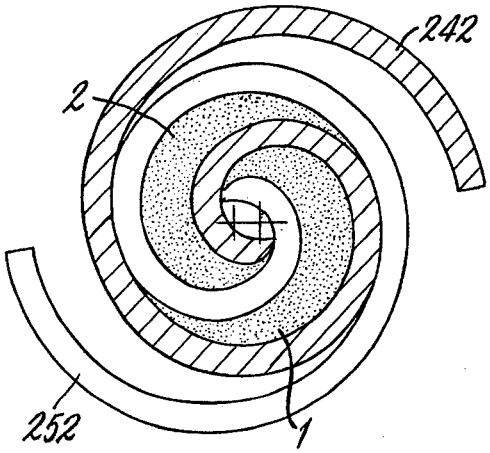
Figure 3D:
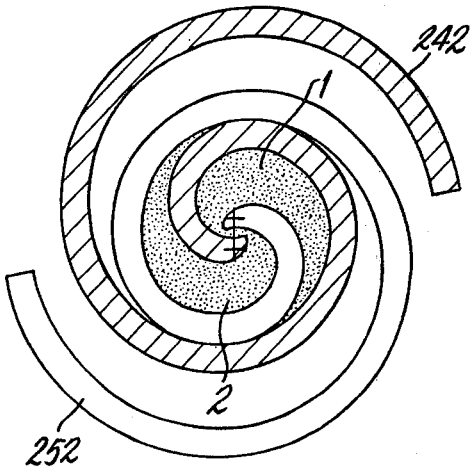

Referring to FIG. 2 in addition to FIG. 1, hollow member 27 includes a cylindrical portion 272 having a rectangular outer contour, on which a rectangular slider member 291 is slidably fitted to permit motion in a radial direction. Rectangular slider member 291 has a rectangular hole with one pair of parallel sides equal in length to one pair of the parallel sides of the outer rectangle of cylindrical portion 272 and with the other pair of parallel sides longer than the other pair of sides of rectangular cylindrical portion 272 by at least twice the offset length between drive shaft 27 and drive pin 23. Accordingly, slider member 291 is slidable on the hollow member 27 in a radial direction along the longer parallel sides of the rectangular hole. Slider member 291 is also fitted into a ring like member 292 which is non-rotatably fixed to the inner surface of cylindrical body 13 of the compressor housing by a key and keyway connection (shown at 293 in FIG. 2). The central hole of ring like member 292 is a rectangular hole with one pair of parallel sides equal in length to one pair of parallel sides of the outer rectangle of slider member 291 and with the other pair of parallel sides longer than the other parallel sides of the same outer rectangle by at least twice the offset length between drive shaft 17 and drive pin 23, so that slider member 291 may slide within ring like member 292 in a radial direction perpendicular to the direction of sliding of it on hollow member 27.

Accordingly, hollow member 27 is permitted to move in two radial directions perpendicular to one another and, therefore, moves along a circle as a result of movement in the two radial directions, but is prevented from rotation. Therefore, the eccentric movement of drive pin 23 by the rotation of drive shaft 17 effects the orbital motion of orbiting scroll member 24 together with hollow member 27 without rotation.

In another construction of ring like member 292, the ring like member has a central hole permitting the hollow member to axially pass therethrough and is formed with a depression in an end surface for receiving and guiding slider member 291. This construction permits the ring like member to be thin.

Fixed scroll member 25 also includes a circular end plate 251 and a wrap means or spiral element 252 affixed onto one end surface of the end plate. End plate 251 is provided with a hole or a discharge port 253 formed at a position corresponding to the center of the spiral elements, and with an annular projection 254 on the rear end surface around the discharge port 253.

The rear end plate 12 is provided with an annular projection 121 on the inner surface thereof around outlet port 15. The outer radius of annular projection 121 is slightly shorter than the inner radius of annular projection 254. Annular projection 121 is cut away along the outer edge of the projecting end to define an annular recess 122. An annular elastic material, for example, a rubber ring 30 is fitted into annular recess 122 and is compressed between interfitted annular projections 121 and 254, so that fixed scroll member 25 is elastically supported on annular projection 121 of rear end plate 12. Rubber ring 30 serves as a seal for sealing off a chamber 31 defined by annular projections 121 and 254 from the interior space 131 of the compressor housing. Chamber 31 connects outlet port 15 and the discharge port of fixed scroll member 25.

End plate 251 of fixed scroll member 25 is formed with a plurality of cut away portions 255 at its rear peripheral edge. A plurality of projections 132 are formed on the inner surface of cylindrical body 13 of the compressor housing and are mated with cut away portions 255, so that fixed scroll member 25 is non-rotatably disposed within the compressor housing. Gaps 32 are maintained between the inner wall of cylindrical body 13 and the peripheral end of fixed scroll member 25, and, therefore, a chamber portion 33 surrounding annular projections 121 and 254 does not form a sealed off chamber within the interior space 131 of the compresor housing. Chamber portion 33 communicates with inlet port 14.

In operation, when drive shaft 17 is rotated by an external power source (not shown) through pulley 20, drive pin 23 moves eccentrically to effect the orbital motion of orbiting scroll member 24. The rotation of orbiting scroll member 24 is prevented by rotation preventing means 29. The orbital motion of orbiting scroll member 24 compresses the fluid introduced in the interior space 131 through inlet port 14, chamber portion 33, and gaps 32, and the compressed gas is discharged from outlet port 15 through discharge port 253 and chamber 31.

Referring to FIGS. *3a–3d*, the introduced fluid is taken into fluid pockets 1 and 2 (which are shown as dotted regions) which are defined by line contacts between orbiting spiral element 242 and fixed spiral element 252, as shown in FIG. *3a*. The line contacts shift by the orbital motion of orbiting spiral element 242 and, therefore, fluid pockets 1 and 2 angularly and radially move toward the center of spiral elements and decrease in volume, as shown in FIGS. *3b–3d*. Therefore, the fluid in each pocket is compressed. When the orbiting scroll member moves over 360° to the status shown in FIG. *3a*, fluid is again taken into newly formed fluid pockets 1 and 2, while the old pockets are connected together to form a reduced pocket and the compressed fluid is discharged from the reduced pocket through discharge port 253.

In the arrangement as described above, since fixed scroll member 25 is axially urged toward orbiting scroll member 24 by the restoring force of compressed rubber ring 30, sealing between end plate 241 of orbiting scroll member 24 and the axial end of fixed spiral element 252, as well as between end plate 251 of fixed scroll member 25 and the axial end of orbiting spiral element 242 is secured. The sealing is reinforced by the fluid pressure discharged into chamber 31. The axial load for securing seal is supported on disk rotor 21 through orbiting scroll member 24, hollow member 27 having radial flange 271, and thrust bearing 28. The axial load is further supported through disk rotor 21 and thrust bearing 22 on front end plate 11 which is secured onto front end of cylindrical body 13 the compressor housing. Therefore, any deflection of the moving parts is prevented during operation of the compressor, so that vibration of compressor and abnormal wear on the parts may be prevented. Since disk rotor 21 which is fixedly mounted on drive shaft 17, is supported through thrust bearing 22 on front end plate 11, drive shaft 17 is securely and nonvibratingly supported by the use of a single needle bearing as a radial bearing.

The radial sealing force at each line contact between fixed and orbiting spiral elements 252 and 242 is determined by the radius of the orbital motion of orbiting scroll member 24 or the offset length between drive shaft 17 and drive pin 23, and the pitch and thickness of each of fixed and orbiting spiral elements 252 and 242. In practical use, the distance between drive shaft 17 and drive pin 23 is preferably selected slightly larger than half of the dimensional difference between the pitch of each spiral element and the total thickness of the fixed and orbiting spiral elements. This arrangement is permitted by the fact that fixed scroll member 25 is radially movably supported by the compressed rubber ring 30. A sufficient radial seal is established, even during initial use of the compressor as assembled. The radial seal is completed when the contact surfaces of both spiral elements wear during use to fit one another.

In the arrangement of the compressor as described above the assembly operation of the compressor is very simple; annular elastic material 30, fixed and orbiting scroll members 25 and 24, rotation preventing means 29, hollow member 27, bearings 26 and 28, and a pre-assembly of drive pin 23, disk rotor 21, bearings 16 and 22, drive shaft 17 and front end plate 11, are inserted in this order into cylindrical body 13 having rear end plate 12, and the compressor is completed by securing front end plate 11 onto cylindrical body 13 by bolt means 34.

The compressor in FIG. 1 has a lubricating system. Cylindrical body 13 of compressor housing is formed with an oil deflector 133 depending from the inner wall thereof into the interior. Front end plate 11 is provided with an oil opening 111 formed in the inner surface adjacent oil deflector 133 and is also provided with an oil passageway 112 formed therein and effecting communication between oil opening 111 and shaft seal cavity 181 within tubular portion 18.

The lubricant oil contained within the compressor housing is splashed by the moving parts such as disk rotor 21 during the operation of the compressor and adheres to and flows along, the inner wall cylindrical body 13 and the parts assembled therein. Thus, the moving parts are lubricated. The oil flowing along the inner wall is directed by oil deflector 133 into oil opening 111 and flows therefrom through oil passageway 112 into shaft seal cavity 181.

Oil deflector 133, oil opening 111 and oil passageway 112 per se are similar to those in the lubricating system disclosed in U.S. Pat. No. 4,005,948.

The oil which flows into shaft seal cavity 181 returns to interior space 131 of the compressor housing after lubricating radial needle bearing 16, the gap between front end plate 11 and disk rotor 21, and thrust needle bearing 22.

Another oil passageway 35 is formed through drive shaft 17 and drive pin 23, which effects communication between shaft seal cavity 181 and the inner space within boss 243. The oil in shaft seal cavity 181 partially flows into boss 243 and, therefrom, flows into the interior of the compressor housing after lubricating radial bearing 26, the gap between disk rotor 21 and radial flange 271, and thrust bearing 28.

The distance r of one end from oil passageway 35 within shaft seal cavity 181 to the central axis of drive shaft 17 is advantageously shorter than the distance R from the other end to the same central axis. Since the centrifugal force at one end of oil passageway 35 within shaft seal cavity 181 is smaller than that at the other end within the boss 243, lubricant oil readily flows into boss 243.

Means for restricting the oil from flowing through the gap between disk rotor 21 and front end plate 11, are provided for example, an O-ring 36 is disposed within the gap. Thus, the oil flowing through radial bearing 26 in boss 243 is increased. In place of O-ring 36, a plastic ring with a square cross-section may be used. The plastic ring is disposed in an annular groove formed in either surface of the front end plate or the surfce of the rotor disk.

In order to separate the oil mixed with the refrigerant gas introduced through inlet port 14, a plate member 37 is fixedly disposed in front of inlet port 14 within annular chamber portion 33. The mixture of the oil and refrigerant gas strikes against plate member 37 and the oil adheres plate member 37. The separated oil drops from plate member 37 and flows down along the inner wall of chamber portion 33. End plate 251 of fixed scroll member 25 and ring like member 292 are provided with oil holes 256 and 294, respectively, at their lower portions. Thus, the lubricant oil stays at the lower portion of the compressor housing.

Referring to FIG. 4, another embodiment is shown which represents a modification of the previous embodiment, and which is characterized in that end plate 251 of fixed scroll member 25 is closely fitted onto cylindrical body 13 of the compressor housing with an O-ring 38 being disposed between the inner wall of cylindrical body 13 and the peripheral end of plate member 251. Accordingly, chamber portion 33 forms a sealed chamber within interior space 131. Therefore, end plate member 251 is formed with another fluid passage hole 257 at the upper portion. Thus, the fluid introduced into chamber portion 33 through inlet port 14 flows into interior space 131, through hole 255 and passes into the fluid pockets between the interfitting spiral elements 242–252.

In this arrangement, since projections 132 as in the previous embodiment are not required to be formed on the inner surface of cylindrical body 13, cylindrical body 13 can be easily made.

In the embodiment shown, rear end plate 12 is not integral with, but is instead separate from cylindrical body 13, and is secured thereto by bolt means 39.

A further embodiment of this invention is shown in FIG. 5 and 6 which is another modification of the embodiment of FIG. 1 and is characterized in that a head block 40 including a discharge chamber 41 and a suction chamber 42 is mounted onto rear end plate 12 and secured thereto by bolt means 43.

Discharge chamber 41 and suction chamber 42 are separated by partitioning wall 401. Chambers 41 and 42 communicate with chambers 31 and 33 through outlet and inlet ports 15 and 14, respectively. Head block 40 is also provided with an inlet connector tube 44 and an outlet connector tube 45 whih communicate with suction chamber 42 and discharge chamber 41, respectively. Connector tubes 44, 45 connect compressor 10 with the refrigerant circulating circuit of a cooling system.

In this embodiment, the refrigerant gas is introduced into suction chamber 42 from the refrigerant circuit through inlet connector tube 44, and, thereafter, flows into interior space 131 of the compressor housing through inlet port 14 and chamber 33. The compressed refrigerant gas discharged from discharge port 253 flows into discharge chamber 41 through chamber 31 and outlet port 15, and, thereafter, circulates to the refrigerant circuit through outlet connector tube 44.

The lubricating oil mixed with the introduced refrigerant gas is separated by an oil separating plate 37' which is fixedly disposed against inlet port 14 within suction chamber 42. The separated oil flows along the inner wall of suction chamber 42 and flows into the interior space 131 of the compressor housing through an oil hole 123 which is formed in rear end plate 12 at a lower portion thereof.

In a further embodiment as shown in FIGS. 7–9, the compressor is provided with means for leaking compressed gas during the operation of the compressor at an increased speed, and is, thus, useful for a refrigerant compressor of an air conditioning system for an automobile wherein the compressor is driven by the automobile engine.

In FIGS. 7 and 8, similar parts are represented by the same reference numerals as the embodiment shown in FIG. 1. Drive pin 23 is provided with a hole 231 formed in the axial end thereof. End plate 241 of orbiting scroll member 24 is formed with a round depression 244 in the surface abutting against the axial end of drive pin 23 and is also formed with a small aperture 245 at the center of the round depression. A ball 46 is received in depression 244, and a compressed coil spring 47 is disposed in hole 231 to urge ball 46 to the center of depression 244. Accordingly, aperture 245 is closed by ball 46. During the operation of compressor 10, ball 46 is subjected to centrifugal force. When the rotating speed of the drive shaft increases, and when the centrifugal force overcomes the force of coil spring 47 which positions ball 46 at the center of depression 244, ball 46 moves from the center of the depression toward the peripheral end to open aperture 245. Accordingly, the compressed gas in a moving fluid pocket leaks through aperture 245 in interior 131 of the compressor housing, when the moving fluid pocket communicates with the small aperture 245. Therefore, when drive shaft 17 is driven at an increased rotational speed, the amount of compressed gas discharged from outlet port 15 is decreased. Thus, the compressing capacity, i.e., the amount of gas compressed in a unit time, is not appreciably different between high speed and low speed operation of the compressor.

The fluid leaking means for leaking compressed fluid during a high speed operation need not be disposed on an axis of drive pin 23 but may be disposed at other portion of orbiting scroll member 24.

In FIG. 9, the fluid leaking means are disposed at a position indicated at A in FIG. 7. Slider member 291 and ring like member 292 are partially cut away to form a space 48 adjacent end plate 241 of orbiting scroll member 24. A bracket 49 is disposed within space 48 and is fixed to end plate 241 by means of, for example, welding. In bracket 49, a coil spring 47' is supported, which, in turn, urges a ball 46' toward end plate 241. End plate 241 is also formed with a round depression 244' for receiving ball 46' therein and has a small aperture 245' at the center of the round depression.

This invention has been described in detail in connection with preferred embodiments, but these embodiments are merely for example only and this invention is not restricted thereto. It will be easily understood by those skilled in the art that other variations and modifications can be easily made within the scope of this invention.

What is claimed is:

1. In a scroll-type fluid compressor unit including a compressor housing having a front end plate and a rear end plate, a fixed scroll member fixedly disposed within said compressor housing and having first end plate means to which first wrap means are affixed, an orbiting scroll member orbitally mounted within said compressor housing and having second end plate means to which second wrap means are affixed, said first and second wrap means interfitting at a predetermined angular relationship to make a plurality of line contacts to define at least one sealed off fluid pocket, a drive mechanism connected to said orbiting scroll member for transmitting the orbital motion to said orbiting scroll member, means for preventing rotation of said orbiting scroll member, and means for supporting a thrust force, the improvement which comprises: said drive mechanism including a drive shaft supported by first radial bearing means in said front end plate and extending outwardly through said front end plate, a disk rotor member mounted on an inner end of said drive shaft and supported by first thrust needle bearing means on an inner surface of said front end plate, and a drive pin axially projecting from a rear surface of said disk rotor member and being radially offset from said drive shaft, said orbiting scroll member being provided with an axial boss formed on a surface of said second end plate member opposite said second wrap means and rotatably mounted on said drive pin which is fitted into said boss through second radial bearing means, said axial boss having a projecting end proximate to said drive pin, a radial flange member extending radially from and disposed on said projecting end of said axial boss and being supported by second thrust needle bearing means on the rear surface of said disk rotor member, a hollow member non-rotatably fitted onto said axial boss and extending axially over an axial space between said radial flange member and said second end plate, whereby the axial force is supported on the inner surface of said front end plate through said hollow member, said radial flange member, said second thrust needle bearing means, said disk rotor member and said first thrust needle bearing means so that deflection of said drive shaft may be prevented, and said rotation preventing means are disposed around said axial boss.

2. The improvement as claimed in claim 1, wherein said rotation preventing means comprise said hollow member which has a rectangular outer contour, a slider member being fitted to said hollow member and being slidable in a first radial direction, said slider member having a rectangular hole and a rectangular outer contour with four sides being parallel to the respective four sides of said rectangular hole, a first pair of parallel sides of said rectangular hole being equal in length to a pair of parallel sides of the outer rectangle of said hollow member, the second pair of parallel sides of said rectangular hole being longer than the other pair of parallel sides of said hollow member so that said slider member may be slidable on said hollow member along said second pair of parallel sides, and a guide member non-rotatably disposed within said housing and having guide surfaces for the respective parallel outer surfaces of said slider member in parallel with said first pair of parallel sides to permit the movement of said slider member in a second radial direction perpendicular to said first radial direction, to thereby permit orbital movement, but prevent rotation of said orbiting scroll member.

3. The improvement as claimed in claim 1, wherein said hollow member is provided with said radial flange formed integrally therewith.

4. The improvement as claimed in claim 1, wherein the distance from said drive shaft to said offset drive pin is selected so that the radius of the orbital motion of said orbiting scroll member is larger than half of the dimensional difference between the pitch of said first wrap means and the total dimension of thickness of said first and second wrap means, whereby the sealing effect of said fluid pocket may be secured by said line contacts.

5. The improvement as claimed in claim 1, further comprising said second end plate means of said orbiting scroll member being provided with a round depression in a surface thereof opposite said second wrap means and having a small aperture at the center of said round depression, a ball receivable in said round depression to close said aperture and spring means to bias said ball into said round depression.

6. The improvement as claimed in claim 1, further comprising said rear end plate of said compressor housing being provided with fluid inlet and outlet ports, a first annular wall axially projecting from the inner surface of said rear end plate around said fluid outlet port, said fixed scroll member being provided with a fluid discharge port at a center of said first end plate means, a second annular wall axially projecting from a surface of said first end plate means opposite said first wrap means around said fluid discharge port, said first and second annular walls being fitted into one another to define a discharge chamber therein to communicate between said outlet port and said fluid discharge port, and an elastic ring member for axially and radially elastically supporting said fixed scroll member and being compressedly fitted into a gap between said first and second annular walls to thereby seal off said chamber from the interior space of said compressor housing.

7. The improvement as claimed in claim 4, further comprising an O-ring disposed between the peripheral end of said first end plate means of said first scroll member and the inner wall of said compressor housing, an annular chamber portion being defined within said interior space of said compressor housing which surrounds said first and second annular projections and connecting to said inlet port, and said first end plate means of said fixed scroll member being provided with a suction port at a peripheral portion thereof to connect said annular chamber portion with the remaining interior space of said compressor housing, whereby fluid is introduced from said inlet port into said interior space of said compressor housing.

8. The improvement as claimed in claim 6, further comprising a compressor head block having a suction chamber and a discharge chamber mounted on said rear end plate, said rear end plate being provided with a hole effecting communication between said suction chamber and said annular chamber portion surrounding said first and second annular walls, said discharge chamber being connected with said outlet port, and a plate member being disposed within said suction chamber for separating oil from gas introduced into said suction chamber.

9. The improvement as claimed in claim 6, further comprising said first end plate means having a plurality of cut away portions at the rear end peripheral edge, said compressor housing having a plurality of radial projections on the inner surface thereof, said radial projections mating with said cut away portions to prevent said fixed scroll member from rotating, an annular chamber portion being defined with said interior space of said compressor housing which surrounds said first and second annular projections and connecting to said inlet port, and a plurality of gaps being defined between the inner surface of said compressor housing and the peripheral end of said first end plate means and between adjacent ones of said radial projections to connect said annular chamber portion with the remaining interior space of said compressor housing, whereby fluid is introduced from said inlet port into said interior space of said compressor housing.

10. The improvement as claimed in claim 9, further comprising a plate member disposed in front of said inlet port within said annular chamber portion to separate out oil from the gas introduced through said inlet port.

11. The improvement as claimed in claim 1, further comprising an oil deflector depending from the inner wall of said compressor housing, said front end plate being provided with a shaft seal cavity around said drive shaft and including an oil opening disposed adjacent said oil deflector and a first passageway formed therein effecting communication between said oil opening and said shaft seal cavity, and a second passageway extending through said drive shaft and said drive pin and effecting communication between said shaft seal cavity and the hollow space of said boss, whereby oil on the inner wall of said compressor housing is directed by said deflector through said oil opening and into said shaft seal cavity, said oil in said shaft seal cavity partially flowing through the gap between said front end plate and said disk rotor member and lubricating said first radial and thrust bearing means, with the remainder of said oil flowing through said second passageway into the hollow space of said boss to lubricate said second radial and thrust bearing means.

12. The improvement as claimed in claim 11, wherein the distance from one end of said passageway in said shaft seal cavity to the central axis of said drive shaft is shorter than the distance to the other end of said passageway from said central axis.

13. The improvement as claimed in claim 11, further comprising means for restricting oil flow, said flow restricting means being disposed within the gap between said disk rotor member and said front end plate.

* * * * *